United States Patent [19]

Wojaczek et al.

[11] Patent Number: 4,828,433

[45] Date of Patent: May 9, 1989

[54] ROOF SUPPORTS

[75] Inventors: Egon Wojaczek, Hamm; Helmut Poklekowski, Lünen; Klaus-Peter Reichelt, Werne, all of Fed. Rep. of Germany

[73] Assignee: Gewerkschaft Eisenhutte Westfalia GmbH, Fed. Rep. of Germany

[21] Appl. No.: 93,913

[22] Filed: Sep. 8, 1987

[30] Foreign Application Priority Data

Sep. 9, 1986 [DE] Fed. Rep. of Germany ..... 3630580

[51] Int. Cl.[4] ..... E21D 23/04

[52] U.S. Cl. ..... 405/296; 405/291; 405/295; 403/150

[58] Field of Search ..... 405/296, 295, 294, 293, 405/291; 403/150

[56] References Cited

U.S. PATENT DOCUMENTS 4,474,510 10/1984 Bull ..... 405/296

FOREIGN PATENT DOCUMENTS 2513361 10/1975 Fed. Rep. of Germany ..... 405/295
2657955 6/1978 Fed. Rep. of Germany ..... 405/295
2720179 11/1978 Fed. Rep. of Germany ..... 405/295
24067 of 1913 United Kingdom ..... 403/150

*Primary Examiner*—Dennis L. Taylor
*Attorney, Agent, or Firm*—Samuels, Gauthier, Stevens & Kehoe

[57] ABSTRACT

A roof support employs an hydraulic piston and cylinder unit as an adjustment device between the goaf shield and the roof-engaging structure. The cylinder unit is mounted to the shield with the aid of a bearing body defining a cup receiving a spherical end of the cylinder. The body also has recesses accessible via offset openings in which journals projecting from the cylinder are located. Locking pieces detachably fitted to the shield block the openings to retain the journals therein yet permit easy assembly and dismantling of the unit.

11 Claims, 3 Drawing Sheets

ROOF SUPPORTS

BACKGROUND OF THE INVENTION

1. TECHNICAL FIELD OF THE INVENTION

The present invention relates in general to mine roof supports and, more particularly, to a shield-type support which employs an hydraulic piston and cylinder unit as an adjustment device between the pivotably-interconnected goaf shield and roof-engaging structure thereof.

2. DESCRIPTION OF PRIOR ART

In conventional shield-type supports of the aforementioned kind and of low structural height or low extension height, the bearing or mounting for the cylinder of the unit on the inside of the goaf shield is largely inaccessible or is only accessible with difficulty so that assembly and dismantling of the unit is difficult. To overcome this problem it is known from German patent specification P34 05 888 to mount an intermediate tube segment on the shield by means of a hinge pin. The tube segment has a socket into which the cylinder can be located as a plug-in joint. The segment partially surrounds the cylinder of the unit and has open recesses for receiving journals on the peripheral wall of the cylinder. With this known arrangement, the cylinder is largely resistant to tensile and compressive forces but is supported for mobility on the shield. The tube segment, which has a length approximately equal to the cylinder of the unit, provides a force transmitting component and allows simple and rapid assembly and disassembly of the unit even if the mounting on the shield is inaccessible. The cylinder can be introduced into the socket of the tube segment and its journals fitted into the reception recesses at all times. The connection joint between the piston rod of the unit and the roof-engaging structure is also accessible at all times and once the cylinder has been released the piston rod joint can be disconnected to free the entire unit. This known arrangement suffers from the disadvantage that the tube segment is bulky and heavy and the location of the journals is not particularly efficient or free from problems.

A general object of the present invention is to provide an improved mounting means for the cylinder of the adjustment unit.

SUMMARY OF THE INVENTION

In accordance with the invention, the mounting means comprises a body rigidly secured to the goaf shield and providing a bearing socket for the cylinder, journals provided on the cylinder, recesses in said body for receiving the journals via openings and locking means detachably secured to the goaf shield to block the openings and maintain the journals within the recesses. The locking means is conveniently fixed to the shield at some distance from the body permitting improved access. Once the locking means is released from the shield and withdrawn, the unit can easily be withdrawn from the bearing body. The recesses are preferably provided with inner and outer end regions offset angularly, e.g. as an L-shaped profile, to facilitate location and retention of the journals and their easy withdrawl. The journals are best located on opposite sides of a ball or spherical shaped end or cap of the cylinder and not on the cylinder wall itself. The mounting means constructed in accordance with the invention provides a releasable tension and pressure resistant connection with the cylinder but avoids unnecessary stress on the cylinder wall.

The locking means may take the form of separate rod-like locking members fixed with detachable pins or bolts to holders on the shield. These locking members may be interconnected or formed as a one-piece stirrup. Each locking member or the stirrup may be formed with a handle at its free end to facilitate its location and removal.

The invention may be understood more readily, and various other aspects and features of the invention may become apparent, from consideration of the following description.

BRIEF DESCRIPTION OF DRAWINGS

An embodiment of the invention will now be described, by way of example only, with reference to the accompanying drawings; wherein.

DESCRIPTION OF PREFERRED EMBODIMENT

Figure 1:
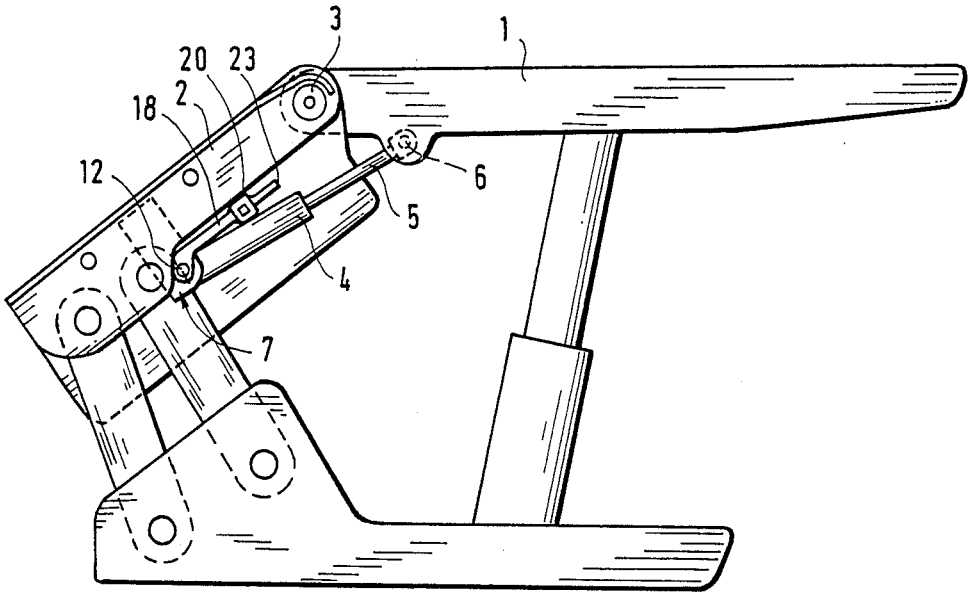
FIG. 1 is a side elevation of a roof support constructed in accordance with the invention.
Figure 2:
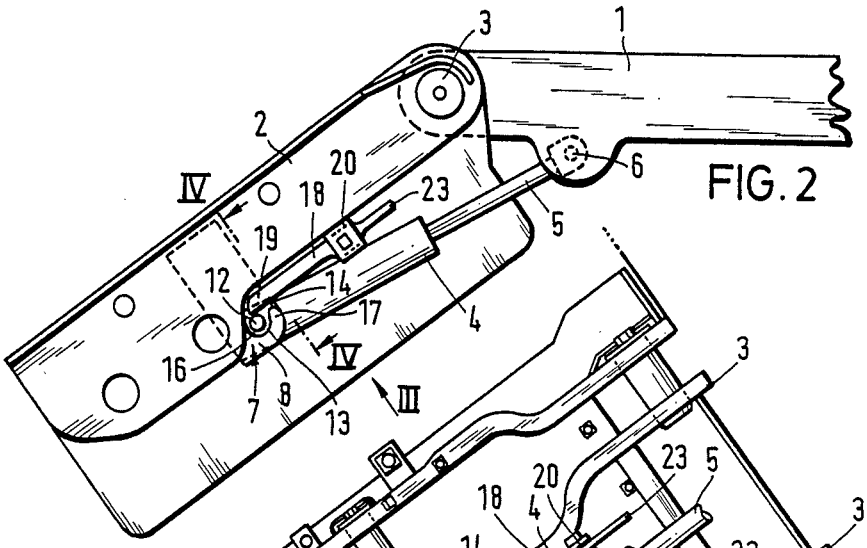
FIG. 2 is a side elevation of part of the roof support showing the piston and cylinder adjustment device thereof.
Figure 3:
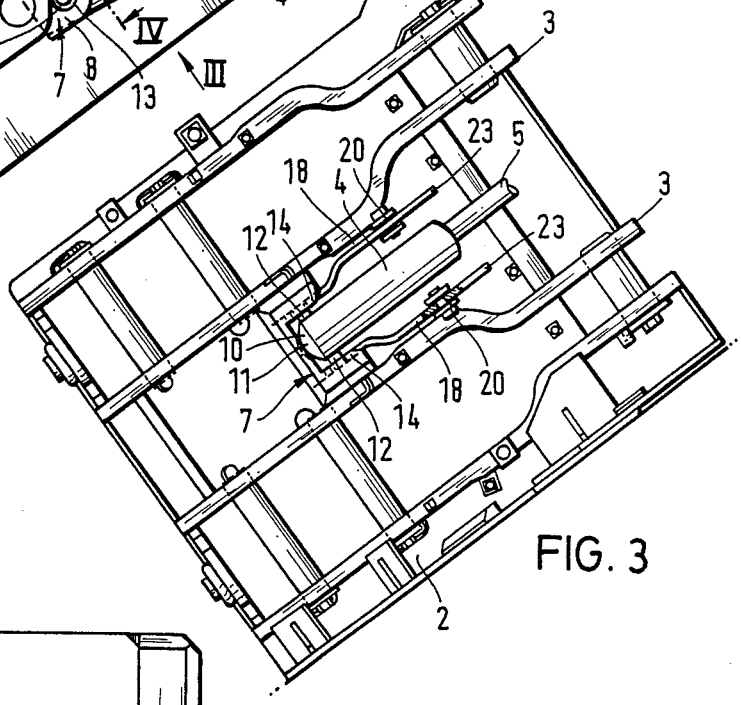
FIG. 3 is a view of the structure shown in FIG. 2 taken in the direction of arrow III in FIG. 2.
Figure 4:
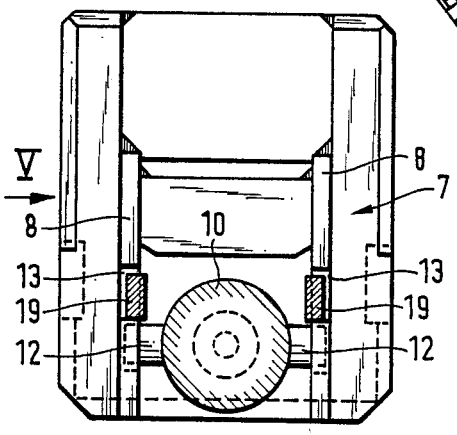
FIG. 4 is a sectional view taken along the line IV—IV of FIG. 2.
Figure 5:
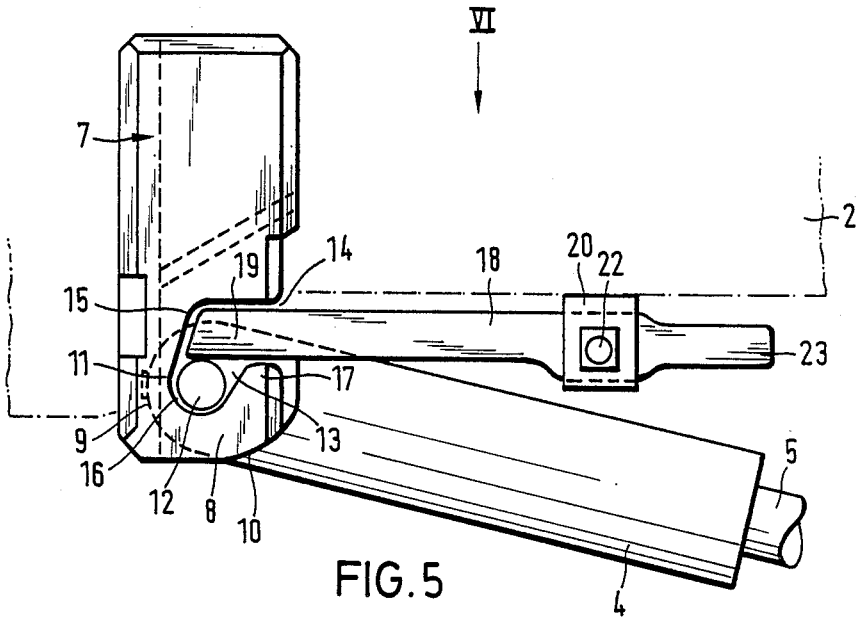
FIG. 5 depicts the cylinder bearing arrangement of the structure, the view being taken in the direction of arrow V of FIG. 4 and on a somewhat larger scale with the shield omitted.
Figure 6:
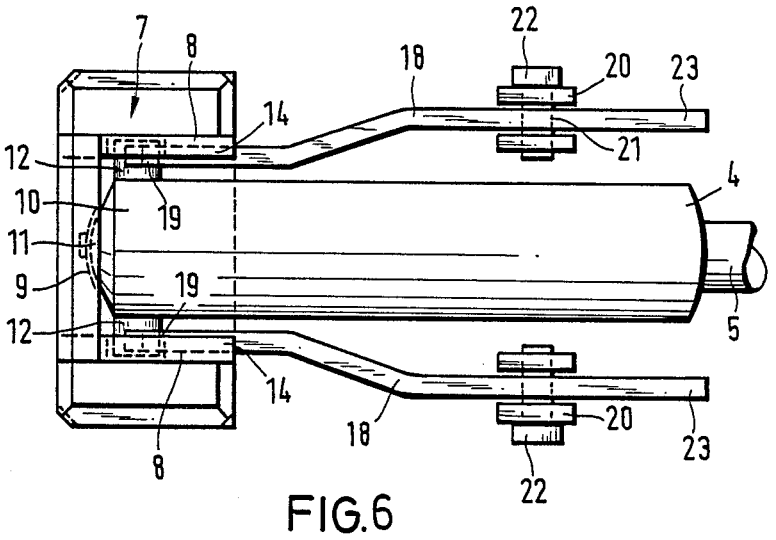
FIG. 6 is another view of the bearing arrangement taken in the direction of arrow VI of FIG. 5 again with the shield omitted.

FIG. 1 depicts a roof support which is of generally known construction except for the novel cylinder mounting means described hereinafter with reference to FIGS. 2 to 6. The support, which may as described in German patent specification No. 2827431, is composed of a roof-engaging structure such as a canopy or girder carried by one or more hydraulic props. The props or prop rest on a floor-engaging structure such as a sill. A goaf shield designated 2 is pivotably connected as at 3 to the rear end of the roof-engaging structure designated 1. Guide levers interconnect the shield 2 with the floor-engaging structure in known manner to form the so-called lemniscate or 'figure-of-eight' guide system. To stabilize the support and to rigidify the pivot joints 3, an adjustment device in the form of a double-acting piston and cylinder unit 4 is operably provided between the roof structure 1 and the shield 2. The unit 4 has its piston rod 5 connected to the roof structure 1 by a releasable pivot joint 6. The cylinder of the unit 4 is connected to the shield 2 via a mounting structure as will now be described. As shown in FIGS. 2 to 6, the mounting structure has a bearing block 7 for the cylinder which takes the form of a cup-shaped body 9 with parallel wall sections 8. The body 9 is rigidly secured to the shield 2. The cylinder of the unit 4 has on its base or foot a ball or spherical cap 11 which fits in the socket or cup defined by the body 9. Cylindrical bearing journals 12 are provided on diametrically opposite sides of the base end region of the cylinder of the unit 4 which defines the cap 11. These journals 12 locate in recesses 13 in the wall sections 8 of the body 9. The recesses 13 are generally L-shaped with inner and outer regions inclined to one another and meeting at junctions 15. The outer regions of the recesses 13 are open as at 14 in FIG. 5 towards the roof structure 1. The inner regions of the recesses 13 terminate with curved surfaces providing seatings 16 for the journals 12. The journals 12 can be introduced to the recesses 13 via the openings 14 and as shown in FIGS. 2 and 5 the journals 12 when located by the seatings 16 lie below the openings 14 behind projections 17 of the wall sections 8.

The journals 12 are secured in the recesses 13 by means of locking members 18 which may be united as a single stirrup piece. The illustrated separate locking members 18 each have a front end portion 19 which engages in one of the openings 14 to close off this associated opening 14 and maintain associated the journal 12 in the inner region of the associated recess 13. The members 18 are detachably fixed to the underside of the shield 2 in a position accessible from the longwall chamber. For this purpose, fork-shaped holders 20 are fitted to the shield 2 (shown in chain-dotted outline in FIG. 5). These holders 20 have bores which are alignable with holes 21 in the members 18 and bolts 22 engage therethrough to secure the members 18 in place. The bolts 22 themselves may be locked with dowels or cotter pins. With the bolts 22 removed the members 18 can be withdrawn from the recesses 13 and conveniently the outer end portions of the members 18 are shaped to form handles 23.

With the locking member 18 removed, the unit 4 can be positioned with its base or foot 10 from below the roof structure 1 and fitted. The journals 12 thus slide into the openings 14 and thence onto the seatings 16 while the cap 11 locates itself into the socket 7. The locking member 18 are then introduced and are fixed to the holders 20. Finally the piston rod 5 is connected to the roof structure 1 via the pivot joint 6. When dismantling the unit 4 it is only necessary to release the members 18 to permit the unit 4 to be lifted clear and accessibility is no problem.

We claim:

1. In a roof support for use in a mineral mining comprising a floor-engaging structure, a roof-engaging structure, at least one hydraulic prop, means for connecting the prop to the roof and floor-engaging structures, a goaf shield, means pivotably connecting the goaf shield to the roof-engaging structure, guide levers pivotably interconnecting the goaf-shield to the floor engaging structure and a piston and cylinder unit pivotably connected between the roof-engaging structure and the goaf shield; the improvement comprising means for mounting the cylinder of the unit to the goaf shield, said mounting means comprising a body rigidly secured to the goaf shield and providing a bearing socket for the cylinder, journals provided on the cylinder, recesses in said body for receiving the journals, openings in the body leading to the recesses for permitting the journals to be introduced into the recesses and withdrawn from the recesses via the openings, and separate locking means detachably secured to the goaf shield to block the openings and maintain the journals within the recesses.

2. A support according to claim 1, wherein the body defines a cup-like socket and the cylinder has a spherical end cap which fits within the socket.

3. A support according to claim 2 wherein the recesses are provided in wall sections of the body alongside the socket.

4. A support according to claim 1 wherein the recesses have outer end regions leading to the openings and inner end regions inclined in relation to the outer end regions, the inner regions having curved inner end surfaces providing seatings for the journals.

5. A support according to claim 1, wherein the locking means comprises at least one locking member securable to a holder fixed to the goaf shield.

6. A support according to claim 5, wherein the locking member has at least one inner end portion which projects into one of openings and at least one outer end portion which is detachably secured to said holder.

7. A support according to claim 6, wherein the end portion of the locking member is secured to the holder with the aid of a bolt engaged through aligned bores in the holder and the locking member.

8. A support according to claim 6 wherein the outer end portion of the locking members is additionally shaped to form a handle.

9. A support according to claim 2, wherein the journals are disposed on diametrically opposite sides of the end region of the cylinder which defines the end cap.

10. A support according to claim 4, wherein the outer end regions of the recesses are partly defined by projections which tend to hold the journals engaged on the seatings.

11. A support according to claim 1, wherein the recesses each have a generally L-shaped profile.

* * * * *